US009134068B2

(12) United States Patent
Choi

(10) Patent No.: US 9,134,068 B2
(45) Date of Patent: Sep. 15, 2015

(54) DIAGNOSTIC METHOD FOR A CLOTHES TREATING APPARATUS

(75) Inventor: Woonje Choi, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 154 days.

(21) Appl. No.: 14/007,126

(22) PCT Filed: Mar. 28, 2012

(86) PCT No.: PCT/KR2012/002264

§ 371 (c)(1),
(2), (4) Date: Sep. 24, 2013

(87) PCT Pub. No.: WO2012/134158

PCT Pub. Date: Oct. 4, 2012

(65) Prior Publication Data

US 2014/0013614 A1 Jan. 16, 2014

(30) Foreign Application Priority Data

Mar. 29, 2011 (KR) ..... 10-2011-0028392

(51) Int. Cl.
*F26B 19/00* (2006.01)
*F26B 23/00* (2006.01)
(Continued)

(52) U.S. Cl.
CPC ..... *F26B 23/001* (2013.01); *D06F 58/22* (2013.01); *D06F 58/28* (2013.01); *D06F 58/20* (2013.01);
(Continued)

(58) Field of Classification Search
CPC ..... F26B 23/00; F26B 23/001; F26B 21/00; F26B 25/00; D06F 58/00; D06F 58/22; D06F 39/10; D06L 1/00; F25D 27/00; F25D 31/00; G05B 15/00
USPC ..... 34/380, 381, 524, 418, 497, 576; 68/19, 68/20, 144; 8/137, 149; 62/79, 228.1, 62/259.3; 700/278, 276
See application file for complete search history.

(56) References Cited

U.S. PATENT DOCUMENTS 2,575,325 A * 11/1951 Ambrose et al. ..... 62/181
4,621,438 A * 11/1986 Lanciaux ..... 34/77
(Continued)

FOREIGN PATENT DOCUMENTS

CN 101929060 A 12/2010
DE 102009002957 A1 * 11/2010 ..... D06F 33/02
(Continued)

OTHER PUBLICATIONS

International Search Report and Written Opinion dated Nov. 1, 2012, issued in Application No. PCT/KR2012/002264.
(Continued)

*Primary Examiner* — Stephen M Gravini
(74) *Attorney, Agent, or Firm* — Ked & Associates, LLP

(57) ABSTRACT

The present invention relates to a diagnostic method for a clothes treating apparatus, and according to an aspect of the present disclosure, there is provided a diagnostic method of a clothes treating apparatus having a compressor, a condenser, an expansion apparatus, and an evaporator for cooling air being discharged from a drum by the evaporator a heat pump, and the method may include activating the compressor; measuring a property (P1) of the refrigerant that has passed through the compressor; re-measuring a property (P2) of the refrigerant that has passed through the compressor after a predetermined period of time has passed; checking whether or not a value F that is defined as P2−P1 is equal to or greater than a predetermined value; suspending the operation of the compressor and repeating the foregoing processes when the value F is less than the predetermined value; and determining that a failure has occurred in the clothes treating apparatus when the execution number of the processes is equal to or greater than the predetermined value.

7 Claims, 3 Drawing Sheets

(51) Int. Cl.

| | |
|---|---|
| ***D06F 58/22*** | (2006.01) |
| ***D06F 58/28*** | (2006.01) |
| *D06F 58/20* | (2006.01) |

(52) U.S. Cl.

CPC ..... *D06F 58/206* (2013.01); *D06F 2058/287* (2013.01); *D06F 2058/2858* (2013.01); *D06F 2058/2887* (2013.01); *D06F 2058/2896* (2013.01); *F26B 23/00* (2013.01)

(56) References Cited

U.S. PATENT DOCUMENTS

| | | | | |
|---|---|---|---|---|
| 7,020,985 | B2 * | 4/2006 | Casey et al. | 34/595 |
| 8,572,865 | B2 * | 11/2013 | Beers et al. | 34/601 |
| 8,595,954 | B2 * | 12/2013 | Lee et al. | 34/487 |
| 2004/0217133 | A1 * | 11/2004 | Ramet | 222/321.9 |
| 2006/0179676 | A1 * | 8/2006 | Goldberg et al. | 34/77 |
| 2007/0107255 | A1 * | 5/2007 | Tamura et al. | 34/475 |
| 2009/0248206 | A1 | 10/2009 | Yoo et al. | |
| 2010/0106334 | A1 * | 4/2010 | Grohman et al. | 700/278 |
| 2010/0108290 | A1 * | 5/2010 | Maxwell | 165/62 |
| 2010/0192639 | A1 * | 8/2010 | Kim et al. | 68/20 |
| 2011/0005097 | A1 * | 1/2011 | Moon et al. | 34/493 |
| 2011/0277334 | A1 * | 11/2011 | Lee et al. | 34/73 |
| 2011/0280736 | A1 * | 11/2011 | Lee et al. | 417/26 |
| 2012/0017464 | A1 * | 1/2012 | Beers et al. | 34/493 |
| 2012/0186139 | A1 * | 7/2012 | O'Brien et al. | 43/132.1 |
| 2014/0013614 | A1 * | 1/2014 | Choi | 34/480 |

FOREIGN PATENT DOCUMENTS

| | | | | | |
|---|---|---|---|---|---|
| DE | 102011078921 | A1 | * | 1/2013 | |
| EP | 2385169 | A1 | * | 11/2011 | |
| JP | 2006-187449 | A | | 7/2006 | |
| JP | 2007-289494 | A | | 11/2007 | |
| JP | 2008-099804 | A | | 5/2008 | |
| JP | 2009028069 | A | * | 2/2009 | |
| JP | 2010-042189 | A | | 2/2010 | |
| JP | 2010-188034 | A | | 9/2010 | |
| KR | 10-2009-0100801 | A | | 9/2009 | |
| WO | WO 2009020311 | A2 | * | 2/2009 | D06F 58/28 |
| WO | WO 2012134158 | A3 | * | 10/2012 | |
| WO | WO 2014/127842 | A1 | * | 8/2014 | |

OTHER PUBLICATIONS

European Search Report dated Feb. 27, 2015 issued in Application No. 12764584.4.

Chinese Office Action dated Mar. 23, 2015 issued in Application No. 201280016356.3 (with English translation).

* cited by examiner

DIAGNOSTIC METHOD FOR A CLOTHES TREATING APPARATUS

CROSS-REFERENCE TO RELATED PATENT APPLICATIONS

This application is a U.S. National Stage Application under 35 U.S.C. §371 of PCT Application No. PCT/KR2012/002264, filed Mar. 28, 2012, which claims priority to Korean Patent Application No. 10-2011-0028392, filed Mar. 29, 2011, whose entire disclosures are hereby incorporated by reference.

TECHNICAL FIELD

The present invention relates to a diagnostic method for a clothes treating apparatus.

BACKGROUND ART

A clothes treating apparatus having a dry function, for example, dryer, may typically supply hot air into a drum in a state that drying objects are loaded within the drum being rotated to remove moisture. Hot air supplied into the drum is generated by applying heat obtained through the burning of fuels such as electrical resistance heating, gas or the like to air being supplied to the drum, but a heat pump may be used for the generation of hot air to reduce the energy consumption.

More specifically, high-temperature air being discharged from the drum may be cooled and condensed by exchanging heat with the evaporator, and air being supplied to the drum is heat exchanged with the condenser to generate hot air. When such a heat pump is used, the amount of heat being discarded during the exhausting or condensing process may be reloaded for the generation of hot air, thereby reducing the energy consumption to that extent.

The heat pump may be operated to implement a refrigerant compression cooling cycle while refrigerant is circulated, and in this case, air being heat exchanged with refrigerant while passing through the evaporator and condenser should be stably supplied to operate the cooling cycle in a stable manner. However, foreign substances such as lint contained in clothes may be mixed in the air being discharged from the drum, and such foreign substances may be adhered to a surface of the evaporator or condenser and thus become a cause of reducing a heat exchange efficiency between air and refrigerant.

To prevent this, a lint removal filter may be provided at a side of the upstream of the evaporator in the related art to minimize the adhesion of lint particles to a surface of the evaporator, but there is a limit in reducing a mesh size of the lint removal filter. As a result, it may be still impossible to remove lint particles having less than a mesh size and thus the adhesion of lint particles to a surface of the evaporator cannot be avoided when the filter is used for a long time. Moreover, foreign substances filtered by the lint removal filter may remain on a surface of the lint removal filter, thereby allowing a cause of preventing the flow of air.

DISCLOSURE OF INVENTION

Technical Problem

However, in case of a lint removal filter, it may easily detached and attached to the dryer by the user to directly remove the accumulated lint particles, but in case of an evaporator provided within the cabinet, the user may have difficulty in accessing the filter and cannot check it with the naked eye prior to the disassembly of the dryer, thereby causing difficulty in the management.

Solution to Problem

The present invention is contrived to overcome the foregoing disadvantages in the related art, and it is a technical task of the present invention to provide a diagnostic method capable of easily determining whether or not a heat transfer efficiency of the evaporator for condensing exhaust air by lint is reduced.

In order to accomplish the foregoing technical task, according to an aspect of the present invention, there is provided a diagnostic method for a clothes treating apparatus comprising a heat pump having a compressor, a condenser, an expansion apparatus, and an evaporator, and the method may include activating the compressor; measuring a property (P1) of the refrigerant that has passed through the compressor; re-measuring a property (P2) of the refrigerant that has passed through the compressor after a predetermined period of time has passed; checking whether or not a value F that is defined as P2−P1 is equal to or greater than a predetermined value; suspending the operation of the compressor and repeating the foregoing processes when the value F is less than the predetermined value; and determining that a failure has occurred in the clothes treating apparatus when the execution number of the processes is equal to or greater than the predetermined value.

In the foregoing aspect of the present disclosure, it may be indirectly checked whether or not there is a failure in the performance of the evaporator or lint filter due to foreign substances such as lint or the like through a change of the property of the refrigerant being discharged from the compressor, thereby easily and quickly diagnose whether or not there is a failure in the clothes treating apparatus compared to a case when checked directly with the naked eye. In other words, if a heat pump system is normally operated since the lint filter and evaporator are normal, then a property of the refrigerant may be maintained almost constant even if a period of time has passed. On the contrary, if heat transfer is not efficiently carried out since foreign substances are accumulated at either one of the lint filter and evaporator, then the cooling compression cycle becomes unstable, and thus a property of the refrigerant may vary due to this as time passes by.

For example, if heat transfer is not efficiently carried out at a side of the evaporator, the temperature of a refrigerant at a discharge side of the compressor increases as time passes by. Accordingly, whether or not a failure has occurred in the lint filter or evaporator can be checked through a change of the property.

Meanwhile, according to the foregoing aspect, it may be determined that a failure has occurred in the clothes treating apparatus even when there is a failure at either one of the lint filter and evaporator, and thus a part at which a failure has occurred cannot be definitely specified. Accordingly, when diagnosed that there is a failure, the process of notifying the user that the time of cleaning a lint filter has arrived may be additionally provided, thereby guiding the user to check a lint filter that can be easily checked to solve the problem in advance.

It may be notified to the user through a control panel, a speaker, or the like provided in the clothes treating apparatus. The user may check the lint filter to clean or replace the lint filter, and therefore, the process of detaching and attaching a lint filter may be carried out to clean or replace the lint filter in this manner.

Accordingly, if it is determined that the same failure has occurred even when checking whether or not the lint filter is detached and attached and performing the foregoing process, then it may correspond to a case in which a failure has occurred in the evaporator, and as a result, the failure can be determined in a quick and accurate manner. To this end, the foregoing method may further include sensing whether or not the lint filter is detached and attached thereto subsequent to notifying that the time of cleaning a lint filter has arrived; performing the processes when sensed that the lint filter has been detached and attached thereto; and notifying that the time of cleaning an evaporator has been arrived when a failure has occurred in the clothes treating apparatus.

Here, whether or not the lint filter is detached and attached thereto may be sensed through a separate switch or the like provided at a lint filter installation portion, and in addition to this, a case that the user directly notifies that an action has been taken for the lint filter through an input device provided at the control panel, for example, a manipulation button or the like, may be also taken into consideration.

Moreover, when suspending and then reactivating the compressor, if the compressor is reactivated after waiting until the heat pump device becomes a completely stabilized state, then whether or not there is a failure can be more precisely determined. In this case, the stabilized state denotes a state that a property of the refrigerant of a heat pump system is maintained constant even if time passes by, and denotes a steady state in a thermodynamic context.

Furthermore, the property P2 may be measured after 6-8 minutes has passed subsequent to the measurement of P1. Moreover, the process of suspending and then reactivating the compressor may be repeated 9 to 11 times.

Advantageous Effects of Invention

According to the aspects of the present disclosure having the foregoing configuration, foreign substances being excessively populated on a surface of the lint filter or evaporator to cause an adverse effect on the operation of a heat pump can be prevented in a quick and easy manner, thereby enhancing the reliability of a product.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODE FOR THE INVENTION

Hereinafter, a diagnostic method for a clothes treating apparatus according to present disclosure will be described in detail with reference to the accompanying drawings.

Figure 1:
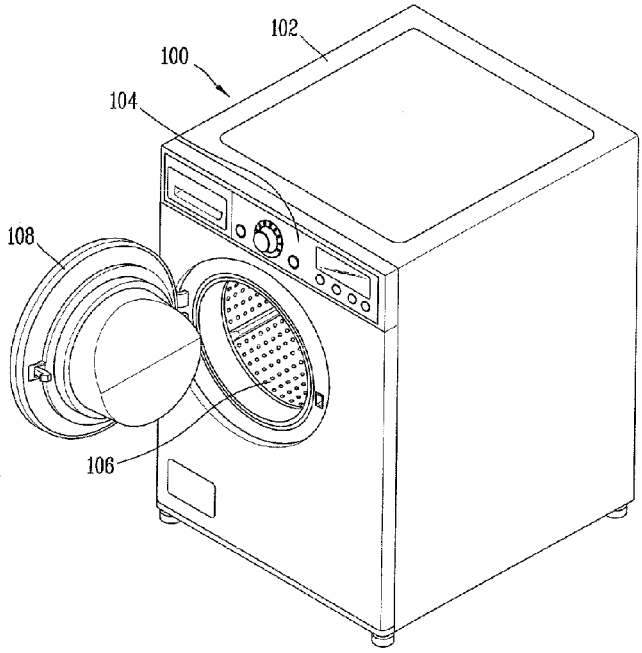
FIG. 1 is a perspective view illustrating a dryer to which a diagnostic method according to an embodiment of the present disclosure is applicable.
Figure 2:
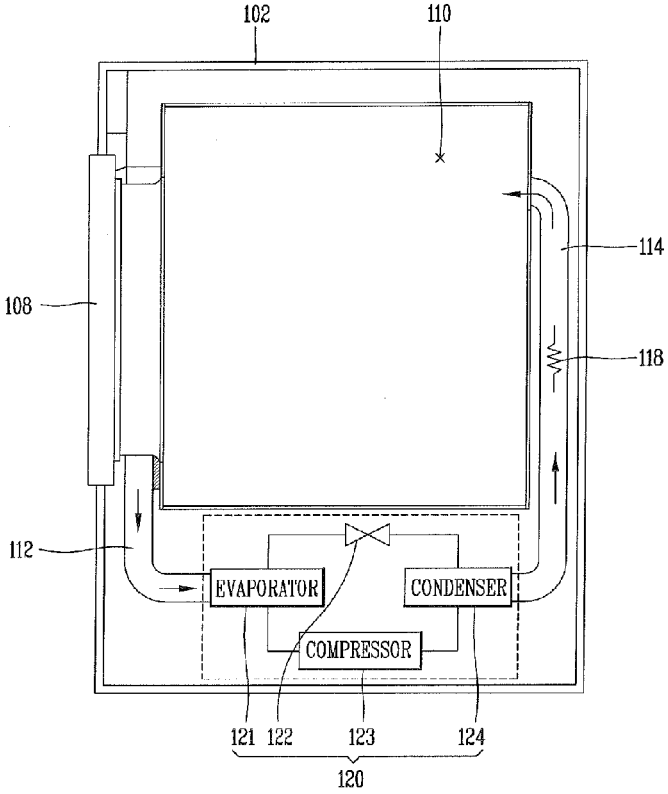
FIG. 2 is an internal structural view schematically illustrating an internal structure of the dryer.

FIG. 1 is a perspective view illustrating a laundry machine having a heat exchanger cleaning device according to an embodiment of the present disclosure. FIG. 2 is an internal structural view schematically illustrating the internal structure of the laundry machine of FIG. 1. Here, the laundry machine of FIG. 1 is a dryer, but the present disclosure is not limited thereto. The present disclosure is applicable to any type of laundry machine or clothes treating apparatus with a drying function that dries laundry placed in a drum by supplying hot air such as a washing machine having a dryer or a stand alone dryer.

With reference to FIGS. 1 and 2, the laundry machine according to the embodiment as shown in FIG. 1 includes a cabinet 100 which may have substantially rectangular parallelepiped shape. The cabinet 100 may have a top plate 102 on a top surface thereof and a control panel 104 at the top of a front surface thereof that controls various functions of the dryer and which may display an operating status. An opening 106 may be formed in the front surface of cabinet 100 to put items to be dried (e.g., clothes), through the opening 106. A door 108 may be installed adjacent to the opening 106 to open or close the opening 106.

A drum 110 is rotatably installed inside the cabinet 100 so that laundry is put into the drum 110. In addition, a lint filter 112, through which air exhausted from the drum 110 may flow, may be formed around the lower part of the front surface of the drum 110. The lint filter 112 may include filter material (e.g., mesh) which filters lint from the air flow as well as form a portion of the flow path through which hot air circulates.

A circulation flow path 116 may be provided downstream of the lint filter 112, and a heat pump 120 may be installed inside the cabinet. Specifically, the heat pump 120 may include an evaporator 121, an expander 122, a compressor 123, and a condenser 124. The evaporator 121 and the condenser 124 may be installed in the circulation flow path 116, while the expander 122 and the compressor 123 may be arranged outside the circulation flow path 116. Therefore, as air that flows in from the lint filter 112 passes through the circulation flow path 116, the air may sequentially flow through the evaporator 121 and the condenser 124, so that cooling (condensation) and re-heating are performed. During the above-described cooling process, moisture in the hot air may be condensed to form droplets of condensed water on the surface of the evaporator or drip from the evaporator 121 for collection. The condensation water generated in this manner may be primarily collected in a condensation water collection portion located under the evaporator 122.

A back duct 114 may be formed downstream of the circulation flow path 116. The back duct 114 is connected such that the hot air flowing in from the circulation flow path 116 can be re-supplied to the drum 110. In addition, an auxiliary heater 118 may be installed inside the back duct 114 to re-heat the hot air that is primarily heated by the condenser 124. The auxiliary heater 118 may be used to prevent a reduction in the temperature of hot air during an initial stage of the heat pump 120 operation during which the heat pump may not provide a sufficient amount of heat. The auxiliary heater may also be used to reduce drying time by providing an additional quantity of heat to supplement the heat generated by the heat pump 120.

As shown in FIGS. 1 and 2, the laundry machine according to the embodiment as shown in FIG. 1 may be a "circulation type" dryer in which hot air exhausted from the drum is cooled, re-heated, and then flows into the drum again. However, the present disclosure is not limited to the "circulation type" dryer, but is applicable to an "exhaust type" dryer in which the hot air exhausted from the lint filter 112 passes through the evaporator 121 alone, is cooled and condensed, and is then exhausted to the outside of the cabinet 100 without passing through the condenser 124.

Figure 3:
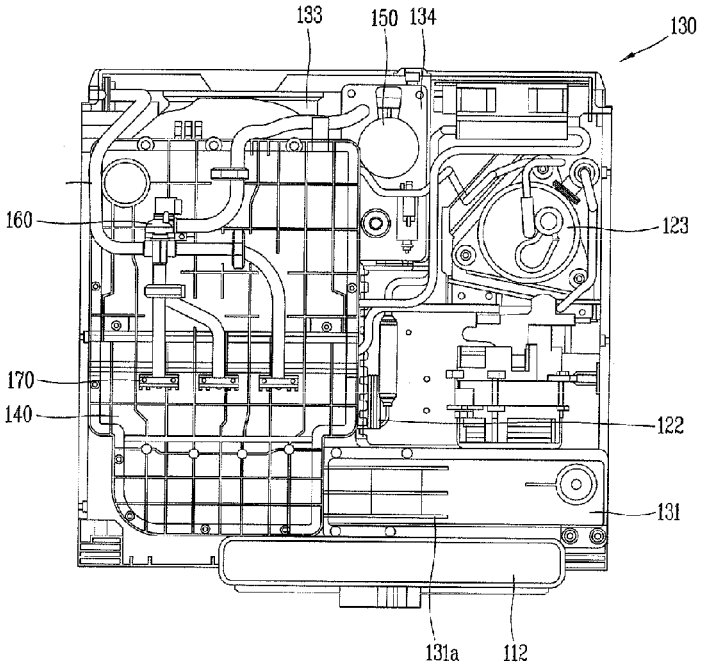
FIG. 3 is a plan view illustrating a base of the dryer.
Figure 4:
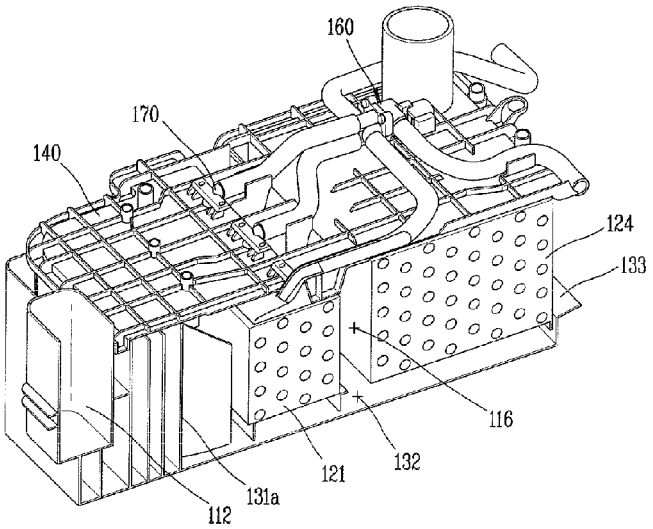
FIG. 4 is a partial cross-sectional view illustrating that the base illustrated in FIG. 3 is cut.

FIG. 3 is a plan view of a base of the laundry machine of FIG. 1, and FIG. 4 is a partial cut-away view of the base of FIG. 3. With reference to FIGS. 3 and 4, a base 130 is provided at a bottom surface of the cabinet 100. The base 130 may form a portion of the circulation flow path 116 (conduit), and may provide a space in which the heat pump 120 may be stably supported. Specifically, the circulation flow path 116 in which the evaporator 121 and the condenser 124 are installed may be provided at the left side of the base, and the expander 122 and the compressor 123 may be provided at the right side of the base, as illustrated in FIG. 3.

The lint filter 112 may be provided at a front part (lower part in FIG. 3) of the cabinet 100, and the circulation flow path guide unit 131 that communicates with the lint filter 112 may be provided. The circulation flow path guide unit 131 communicates with the lint filter 112 and guides the hot air exhausted from the drum 110 to the evaporator 121. To this end, a plurality of guide veins 131*a* may be formed in the circulation flow path guide unit 131 to guide air to the evaporator 121.

The hot air guided by the guide veins 131*a* flows into the circulation flow path 116. The circulation flow path 116 may be defined by a cover plate 140 that covers a top part of a space formed by the bottom surface of the base 130 and a partition (not shown) formed on the base 130. That is, the circulation flow path 116 may be a conduit that is formed by the cover plate 140 and the partition of the base 130. Air that passes through the circulation flow path 116 passes through the evaporator 121 and the condenser 124 and flows into the back duct 114 through a back duct connection unit 133 that is formed at a rear surface of the base 130.

The bottom surface of the base 130, on which the evaporator 121 and the condenser 124 are arranged, may serve as a condensation water collection portion 132. That is, the condensation water generated through condensation by the evaporator 121 is primarily collected in the condensation water collection portion 132. The collected condensation water may flow into a condensation water storage portion 134 that is arranged adjacent to the compressor 123. The condensation water collection portion 132 and the condensation water storage portion 134 may be separated from each other by a partition and may communicate with each other through holes formed in the partition.

Therefore, when a level of the condensation water collected in the condensation water collection portion 132 becomes higher than a predetermined level, the condensation water may flow into the condensation water storage portion 134 through the holes and stored therein. The condensation water stored in the condensation water storage portion 134 may be supplied to a control valve 160 that is installed at the upper part of the cover plate 140 using a pump 150. The pump 150 may be provided in the condensation water storage portion 134, as described in further detail hereinafter.

The control valve 160 distributes condensation water supplied by the pump 150 to each cleaning nozzle 170 to remove foreign substances such as lint particles adhered to a surface of the evaporator 121.

Here, a plurality of the cleaning nozzles 170 should not be necessarily required, and cleaning the entire evaporator using one nozzle may be also taken into consideration, and an example of removing lint using a brush provided to be moved along a surface of the evaporator may be also taken into consideration.

Hereinafter, the operation of the dryer will be described.

Figure 5:
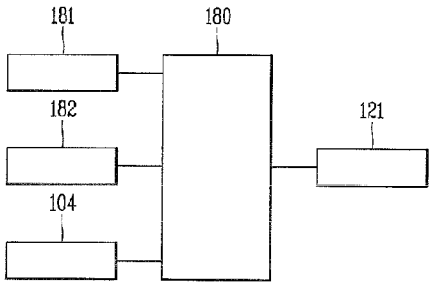
FIG. 5 is a block diagram schematically illustrating a control system of the dryer.

FIG. 5 is a block diagram schematically illustrating a control system of the dryer. Referring to FIG. 5, the controller 180 provided to control the operation of the dryer according to a signal or information received from the control panel 104 by the user applies or blocks a current to or from the compressor 123 and auxiliary heater 118 to control the operation thereof. Meanwhile, the controller is electrically connected to a switch 181 provided to be protruded at an inner portion of the lint filter installation portion 112 to sense whether or not the lint filter is detached and attached thereto, and a refrigerant temperature sensor 182 for measuring a temperature of the refrigerant being discharged from the compressor. In this case, the refrigerant temperature sensor 182 may be adhered to a surface of the discharge pipe of the compressor to indirectly measure the temperature of the refrigerant.

In addition to the switch 181, an example of a manipulation button allowing the user to directly input whether or not the lint filter is detached and attached to the control panel 104 may be also taken into consideration.

Figure 6:
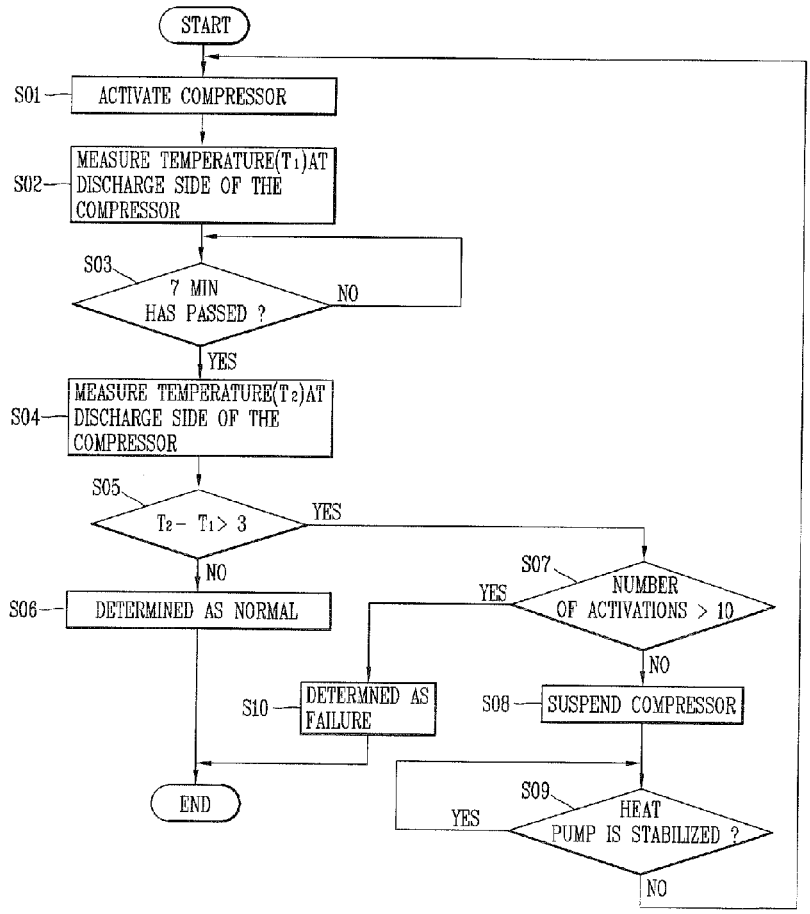
FIG. 6 is a flow chart illustrating the process of performing diagnosis according to the above embodiment.

FIG. 6 is a flow chart illustrating the process of performing a diagnostic method of checking whether or not a failure has occurred in the dryer by the controller. Referring to FIG. 6, when a diagnostic operation is started, the controller 180 applies a current to the compressor to activate the compressor (step S01). Then, the controller measures a temperature (T1) of the refrigerant at a discharge side of the compressor (step S02), and then re-measures a temperature (T2) of the refrigerant at a discharge side of the compressor (step S04) after seven minutes has passes (step S03). At this time, in the step S03, T2 is scheduled to be measured after seven minutes has passed to prevent diagnostic errors due to a temporary environmental change, and the time may be determined between approximately six and eight minutes.

In step S05, the controller checks whether or not a value of T2−T1 is greater than 3° C., and determines it as normal when the value is equal to or less than 3° C. (step S06). Otherwise, the controller checks whether or not the number of suspending and reactivating the compressor is greater than 10 during the entire diagnostic process (step S07). If greater than 10 (step S10), then the controller determines it as failure, and if equal to or less than 10, the controller suspends the operation of the compressor (step S08), and then the controller waits until the heat pump reaches a stabilized state or steady state (step S09), and then the routine returns to the step S01 to repeat the foregoing processes.

Here, the suspension and reactivation is repeatedly carried out ten times to prevent an error from being generated in the diagnostic result due to external disturbance such as a temporary environmental change, and the number of suspending and reactivating the compressor may be determined between approximately nine and eleven.

Figure 7:
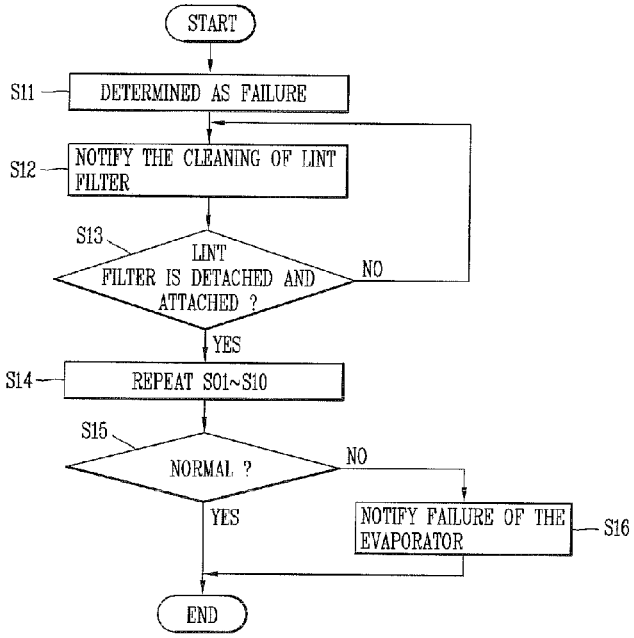
FIG. 7 is a flow chart illustrating the process of checking a part having a failure between the lint filter and evaporator in the above embodiment.

Meanwhile, in the step S10, it may be checked whether or not there is a failure in the operation of the dryer, but at which side of the lint filter and evaporator a failure has occurred cannot be checked. To check this, the process illustrated in FIG. 7 may be additionally carried out.

In other words, if it is determined that there is a failure through the foregoing processes (step S11), then the controller notifies the user through the display device, speaker, or the like provided in the control panel that the time of cleaning a lint filter has arrived (step S12). To allow the user to clean or replace the lint filter through the alert message, the lint filter may be detached and then reattached, and whether or not the lint filter has been detached and attached may be checked through a switch provided in the lint filter installation portion (step S13). Here, the step S13 may be carried out by sensing whether or not the lint filter is detached and attached as described above, but an example of allowing the user to directly input to the controller whether or not the lint filter has been cleaned or replaced through a manipulation button provided on the control panel as an input means may be also taken into consideration.

In this manner, if the lint filter is cleaned by the user, then the steps S01 through S10 illustrated in FIG. 6 are repeated (step S14) to diagnose once again whether or not there is a failure (step S15). If it is determined that there is also a failure in the step S14, then it corresponds to a case where there is a failure in the evaporator, and thus the controller notifies the user that there is a failure in the evaporator (step S16).

Through the foregoing processes, it may be possible to check at which side of the lint filter and evaporator a failure has occurred, and if a failure has occurred at the evaporator in the step S16, then the evaporator may be cleaned through the cleaning nozzle 170.

Furthermore, when it is determined that a failure has occurred even when performing the processes illustrated in FIGS. 6 and 7 again after cleaning the evaporator, then it corresponds to a case where a failure has occurred due to another reason other than foreign substances such as lint particles, and thus it may be notified to the user, thereby allowing the user to take an action.

The invention claimed is:

1. A diagnostic method for a clothes treating apparatus comprising a heat pump having a compressor, a condenser, an expansion apparatus, and an evaporator, the method comprising:

activating the compressor;

measuring a property (P1) of the refrigerant that has passed through the compressor;

re-measuring a property (P2) of the refrigerant that has passed through the compressor after a predetermined period of time has passed;

checking whether or not a value F that is defined as P2−P1 is equal to or greater than a predetermined value;

suspending the operation of the compressor and repeating the foregoing processes when the value F is less than the predetermined value; and determining that a failure has occurred in the clothes treating apparatus when the execution number of the processes is equal to or greater than the predetermined value.

2. The method of claim 1, wherein the property of the refrigerant is a temperature of the refrigerant.

3. The method of claim 1, further comprising:

notifying the user that the time of cleaning a lint filter has arrived when determined that a failure has occurred in the clothes treating apparatus.

4. The method of claim 3, further comprising:

sensing whether or not the lint filter is detached and attached thereto subsequent to notifying that the time of cleaning a lint filter has arrived;

performing the processes disclosed in claim 1 when sensed that the lint filter has been detached and attached thereto; and notifying that the time of cleaning an evaporator has been arrived when a failure has occurred in the clothes treating apparatus.

5. The method of claim 1, wherein the compressor is reactivated after a predetermined time has passed subsequent to suspending the compressor.

6. The method of claim 1, wherein P2 is measured after 6-8 minutes has passed subsequent to the measurement of P1.

7. The method of claim 1, wherein the process of suspending and then reactivating the compressor is repeated 9 to 11 times.

* * * * *